United States Patent [19]

Brice

[11] 4,110,168

[45] Aug. 29, 1978

[54] PROCESS FOR THE SEPARATION OF TARRY DUSTS FROM COKE OVEN GAS

[75] Inventor: Henri Brice, Saint-Avold Moselle, France

[73] Assignee: Houilleres du Bassin de Lorraine, Freyming-Merlebach, France

[21] Appl. No.: 755,450

[22] Filed: Dec. 29, 1976

[30] Foreign Application Priority Data

Jan. 22, 1976 [FR] France ..... 76 01648

[51] Int. Cl.[2] ..... C10B 27/00; C10B 27/04

[52] U.S. Cl. ..... 201/4; 201/40; 201/41; 202/254; 208/39

[58] Field of Search ..... 201/2, 4, 29, 40, 41; 202/254, 255, 256, 258, 263, 241; 208/39, 48 R

[56] References Cited

U.S. PATENT DOCUMENTS

| | | | |
|---|---|---|---|
| 1,924,163 | 8/1933 | Miller | 208/39 X |
| 2,016,051 | 10/1935 | Rhodes et al. | 201/26 |
| 2,975,109 | 3/1961 | Van Ackeren | 202/255 X |
| 2,976,230 | 3/1961 | Emery et al. | 208/8 |

FOREIGN PATENT DOCUMENTS

| | | | |
|---|---|---|---|
| 917,388 | 7/1954 | Fed. Rep. of Germany. | |
| 283,233 | 12/1970 | U.S.S.R. | 208/39 |

*Primary Examiner*—Morris O. Wolk
*Assistant Examiner*—Arnold Turk
*Attorney, Agent, or Firm*—Cushman, Darby & Cushman

[57] ABSTRACT

A process for the facile isolation of distillation by-products of coking operations, which include dusts and tars, comprising cooling said distillation by-products with ammoniacal waters and adjusting the dust:tar ratio between 1.3 and 1.6, thereby allowing separation of substantially clarified ammoniacal waters and a substantially solid product of said tars and dusts.

5 Claims, 2 Drawing Figures

PROCESS FOR THE SEPARATION OF TARRY DUSTS FROM COKE OVEN GAS

The invention relates to a process for the separation of tarry dusts collected in high concentration in ammoniacal waters, known as "mixes". Said ammoniacal waters are used for cooling and washing dust-laden gases from coke oven chambers of the by-product recuperation type, such as gases collected when charging dry or preheated coal, and which are recovered at the outlet of a main (conduit) serving the chambers.

In the course of the carbonization of coal mixtures for the production of coke, distillation in the chamber produces a mixture of gases, tars, and water vapor. This mixture leaves the carbonization cell at from 600° to 800° C. and may entrain a certain amount of dust. The gases are introduced into a horizontal pipe, known as a main, by way of a vertical pipe, known as a riser, and of an inclined pipe, known as a horse head and generally provided with an isolating valve having a wet lute and having a plate forming a sealing valve. In the main the tarry and the dust-laden gases, when present, are cooled with the aid of ammoniacal waters injected through atomizers; part of the tars, the water vapor, and any dust present are retained. The mixture of tars, dusts, condensed water, and ammoniacal waters, which is known as the "mix", must be treated in order to separate the tars and the dusts, on the one hand, and the ammoniacal waters on the other hand.

When wet coal is charged, as is usually the case with good coking coals, a single main is generally provided, and the gases, the tars, and the charging dusts, as well as the products distilled throughout a carbonization cycle, are collected in this same main. The mix is passed into a primary decanter, which makes it possible to separate the tars and dusts, on the one hand, and the clear ammoniacal water on the other hand, the latter being recycled to the main. It is known that when considerable amounts of dusts are entrained, difficulties occur in connection with the decantation since the treated ammoniacal waters still contain tars and dusts when they are recycled to the charging main. Said main, being neither cooled nor bathed by the ammoniacal waters, very quickly becomes clogged. It is then necessary to clean said main and even to interrupt the operation of the oven, thereby entailing very serious disadvantages.

Although the technique of preheated coal charging is not new, said technique which hitherto has been little used is being developed. This technique, which makes it possible to produce metallurgical coke with coals considered to be unsuitable for producing coke, consists in charging coal which has previously been dried at a temperature of at least 100° C. and possibly even as high as 260° or 280° C. However, those versed in the art also know that the charging of preheated coal leads to much greater entrainment of dusts in the gases due to the fact that the wet charging and the emission of these dusts take place essentially at the moment when the coal is introduced into the oven. If a single main is used, it, very quickly, ceases to operate because of the inability to achieve suitable decantation of the mix.

Thus, in order to avoid soiling all the tar by admixture with dusts, it has already been proposed to install two mains. A first main is used during the charging and for a period of a few minutes thereafter, for example 5 to 10 minutes. This first main collects the dusts entrained during the charging and a little tar mixed with the ammoniacal waters, giving rise to a mixture termed the "charging main" mix. The second main is used during the remainder of the carbonization and contains dust-free mixes which entail no particular problem in connection with treatment, and even less problems than those which inhere in treatment of "mixes" from wet charging.

The art recognizes a charging main utilization time which leads to the obtaining of dusts containing no more than 8% and sometimes as little as 3% of tar, that is to say, a dust/tar ratio of the order of 12 to 35.

However, it is difficult to separate these mixes which pass out of the charging main from the ammoniacal waters. With a few unexplained exceptions, the mix cannot decant completely from the ammoniacal waters. At the same time, the mix of tarry dusts is usually, if not almost always, dispersed in the ammoniacal waters, some of it sinking and some of it floating and having a water content as high as 60 to 80%. Users of the preheated charging process are then at grips with the problem of eliminating these wet, tarry muds.

A common solution often adopted to solve this problem comprises passing the mix leaving the charging main into a decanter-separator, from which two products are extracted: (1) a mud or sludge formed by mixing the floating and sinking products, which is passed to a flotation cell, and (2) the ammoniacal waters, which are recycled.

The mud or sludge is treated in a flotation cell after being mixed with a flotation agent. The floated product is thickened in a vacuum filter, and the clear product is recycled.

This solution however, had disadvantages, since in fact, in practice, dusts are obtained which have a wide granulometry range and of which only one fraction can be treated in a flotation cell. The coarsest fraction escapes this treatment and consequently remains in the ammoniacal waters, thereupon clogging the nozzles of the main and rendering the latter incapable of operation. Furthermore, if there is a large proportion of tars in the dusts, the flotation cell functions badly and the vacuum filter becomes clogged. Moreover, the clarified waters passing out of the flotation cell still contain dusts and, since these waters are recycled, there is once again a risk of the clogging of the nozzles of the main.

The aim of the invention is to overcome the abovementioned disadvantages and to permit recovery, on the one hand, of the tars and dusts which are eliminated; while only one-third or one-quarter of the amount of water previously used is in circulation because of increased efficiency in the cleaning of the main, and to permit recovery, on the other hand of ammoniacal waters practically free from dust and tar and capable of being recycled to the charging main without entailing operating difficulties, such as the clogging of atomizers, pipes, and so on.

Another aim of the invention is to propose a process which offers great simplicity of performance and is economic in respect of investment and operation.

DESCRIPTION OF THE INVENTION

According to the invention the aim is achieved by adjusting, during or after the cooling, the weight ratio of the mass of dusts to that of tars, in the ammonia water output or in a means used for decantation and separation below, to a range substantially between 1.3 and 1.6; then the mix is introduced into a decantation basin of known type, such as a point type (conical) decanter or scraper tank; the decanted tarry dusts are separated from the basin and the ammoniacal waters clarified by said separation are recycled without further treatment (to the atomizer nozzles of the main). In order to facilitate the separation of the components, it is preferable that the temperature of the waters in the separation basin, e.g., decantation basin, which depends on several parameters, for instance, insulation, etc., should be kept between 50° and 80° C. Thus, the quantity of ammoniacal waters are used in amounts which are effective to cool the dust-laden-tar containing gases from the coke ovens and to remove the dust and tars from said gases and to assist in maintaining the temperature of ammoniacal waters in the separation basin at 50° to 80° C.

This process of the invention allows not only the decantation of the dust and tar complex, but also easy recovery of this complex, which decants in compact (substantially solid) form containing a maximum of 20 to 30% of water and, at the overflow of the decanter, easy recovery of ammoniacal waters containing less than 100 mg/l of dusts and less than 100 mg/l of tars.

The discovery of the invention is that adjustment of the weight ratio of the mass of dusts to that of tars to a weight ratio ranging substantially between 1.3 to 1.6 allows for recovery of said dust and tar complex and recycling of the ammoniacal waters, separated therefrom directly to the main without further purification treatment.

The invention runs counter to accepted ideas, because in accordance with the invention the dust/tar ratio must be about 10 to 35 times lower than the minimum ratio which was previously considered practicable: That is, either the charging main must be left connected with the ovens for a longer time than necessary, in order to receive therein a substantial but controlled amount of tar, or tar must be introduced in controlled amounts into the tarry dust to achieve said weight ratio.

In a process in which the dust-tar ratio is controlled by disposing between each chamber and a charging main an opening and closing means whose opening time is adjustable, according to the invention the said means should have fluid-tight closing, such as that of a type known per se.

A means of this kind has for example been described in French Patent Application No. 75.30186 of Oct. 2, 1975.

It is then convenient to regulate the dust/tar ratio by regulating the opening time of fluid-tight opening and closing means at the moment when charging is effected.

In an improved embodiment the dust/tar ratio is regulated by regulating the opening time of the fluid-tight opening and closing means, at the moment when charging is effected, in combination with the opening for a regulated time of at least one fluid-tight opening and closing means disposed between the main and another chamber.

In a variant, the dust/tar ratio is regulated by regulating the opening time of the fluid-tight opening and closing means, at the moment when charging is effected, in combination with the controlled introduction of tarry gases coming from another main, such as the principal main disposed for collecting the coke oven gases during the closure time of the aforesaid fluid-tight opening and closing means.

In another variant the dust/tar ratio is regulated by introducing a controlled amount of condensed tar into the main.

In this case it is convenient for the condensed tar to be introduced in a controlled amount into the main by introducing a mix coming from another main, such as the principal main provided for collecting coke oven gases during the closure time of the aforesaid fluid-tight opening and closing means.

DESCRIPTION OF THE DRAWINGS

Other characteristics and advantages will be clear from the examples and description given below, solely by way of example, of one embodiment of the invention. To this end reference will be made to the accompanying drawings, in which:

FIG. 1 shows the flow-sheet of an installation applying the process. The top part of the diagram will first be considered, showing symbolically the principal main 20 and the charging main 3 of a coke oven (not shown) which has a plurality of chambers, and also the pipes 55 which supply the nozzles 5 with ammoniacal water for washing the gases.

The mains are connected to each chamber of said plurality of chambers by risers 1 and are connected as described below, in accordance with French Patent Application No. 75.30186 referred to previously as in FIG. 2.

Figure 2:
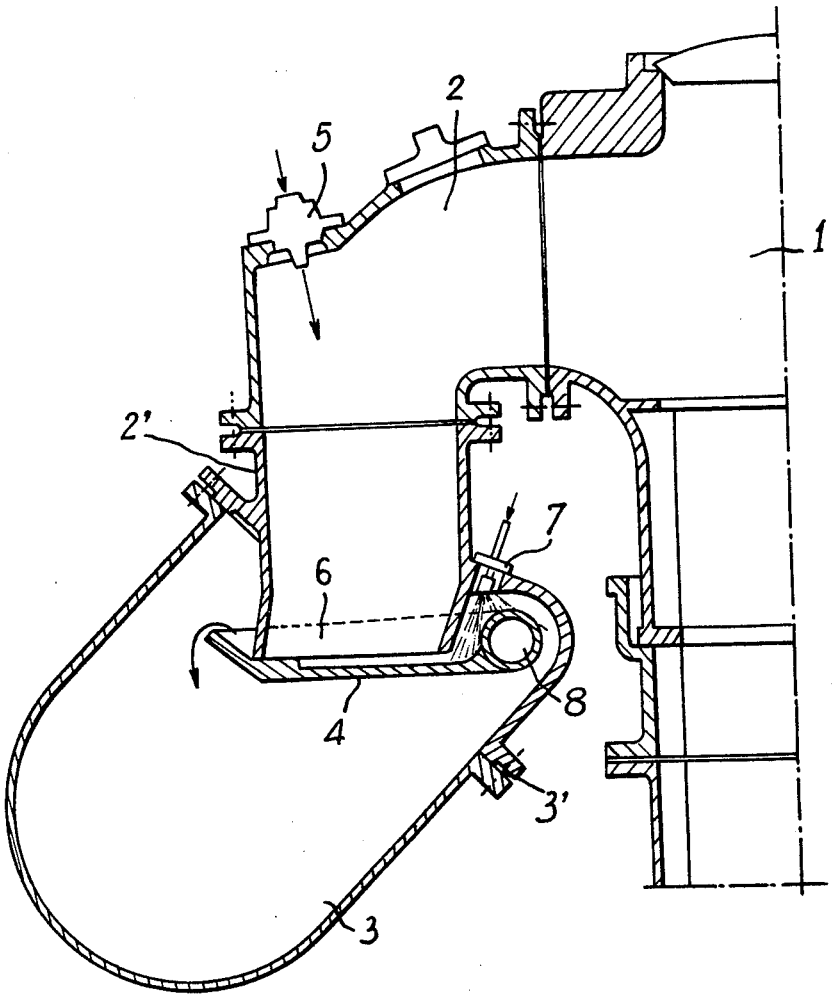
FIG. 2 is a view in vertical section through a riser and a main in a coke oven, such as can be utilized in the invention.

The coke oven risers 1 of FIG. 2 each comprise a horsehead-shaped connection 2 to one of the mains (main 3 being shown) by a flanged joint 3'. The horsehead 2 may be separated from the main 3 by a plate 4 which has a horizontal pin 8 and which is shown in the horizontal closure position. On the plate side the horsehead 2 ends in a ring 2' whose bottom portion coincides with the plane of the plate 4 in the horizontal position, so as to form a wet lute 6 supplied with ammoniacal water by means of an injection nozzle 5. At 7 is disposed an injector which sprays the pin 8 of the plate 4 so as to ensure perfect sealing when the latter is closed.

As is known per se, the mains are in addition provided, if necessary, with additional ammoniacal water injectors 5.

Figure 1:
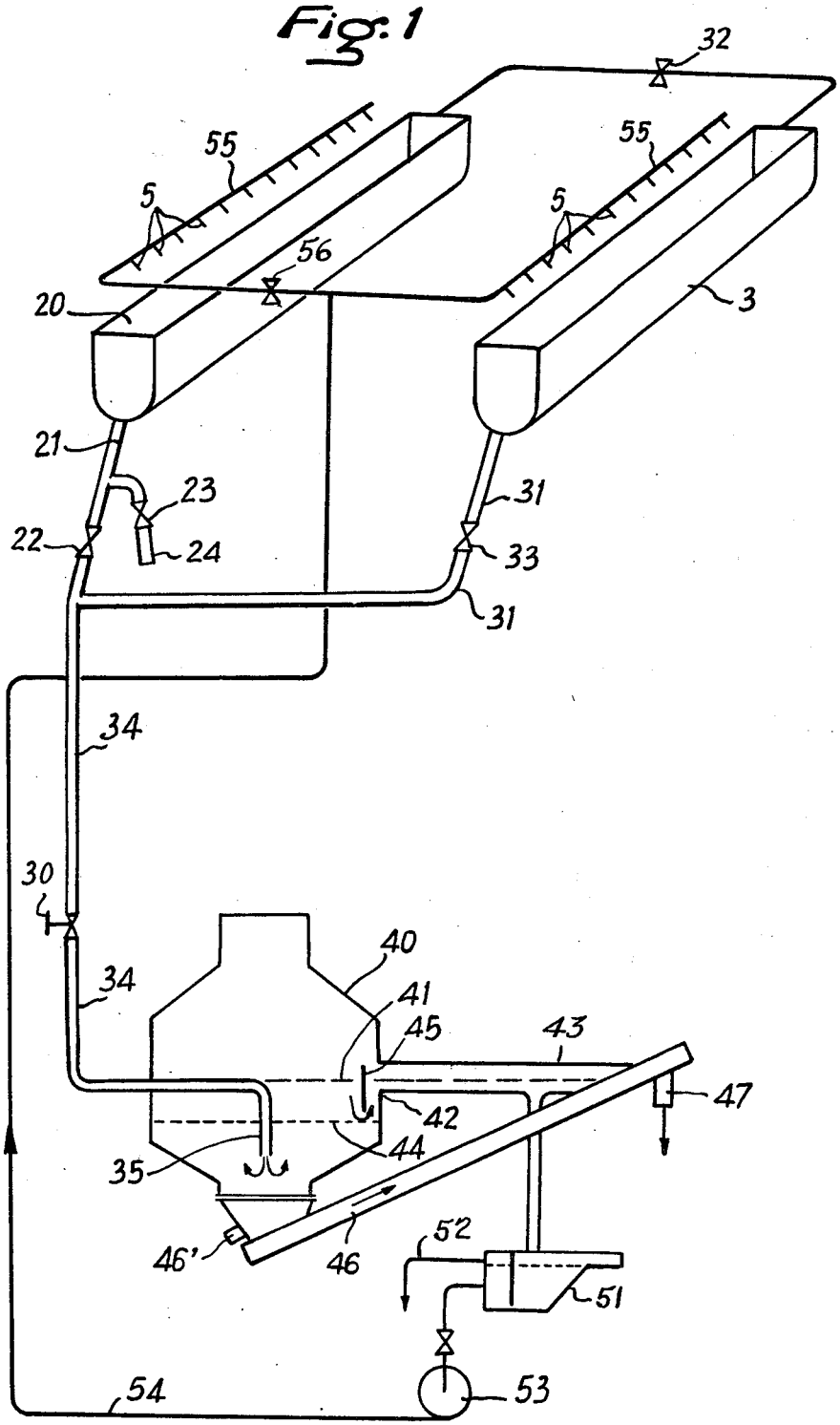
FIG. 1 shows the general diagram of an installation applying the process of the invention.

The ammoniacal waters laden with tars and dusts are discharged from the main 3 in FIG. 1 by a pipe 31 and from the main 20 by a pipe 21 and a pipe 24 controlled by a normally open valve 23. A branch from the pipe 21 is normally closed by a valve 22 and is connected to the pipe 31 to lead into a collecting pipe 34 having a valve 30 which extends towards a decantation tank which will be discussed later on. The gaseous atmospheres of the two mains 3 and 20 may be brought into communication by a pipe provided with a balancing limiter (flow or pressure equalization) valve 32. The ammoniacal water discharge pipe 31 is provided with a simple operating valve 33.

The ammoniacal waters are lead into a decanting tank 40 by way of an immersed pipe 35, as will be explained later on.

In the decantation tank 40 a liquid level 41 is established by means of an overflow or outlet threshold 42 feeding a discharge pipe 43. At the bottom of the tank is formed a deposit of material comprising tars and dusts, whose level is established at 44 under normal operating conditions. The pipe 35 has its outlet below this level, as is known per se. The tank is also provided with a floating material barrier 45 constituting a baffle, as is also known per se. The bottom of the tank leads onto a conveyor screw 46 which discharges sinking material, which can then be loaded at 47 onto trolleys, for example.

The overflow pipe 43 in turn supplies the overflowing ammoniacal waters to a regulator tank 51, which has an overflow threshold 52, and which normally feeds a pump 53 recycling the ammoniacal waters to the pipes 55 and atomizers 5 of the horseheads and main 3 and main 20 through a pipe 54, if valve 56 is open.

The charging mix coming from the battery of ovens charged with preheated coal is therefore delivered into the tank 40, which has a diameter of about 4 meters. The pipe, which for example has a diameter of 150 mm, is immersed in the liquid to a depth of about 1500 mm.

The level is regulated by an overflow provided with a baffle, as already stated, in order to prevent the entrainment of foam and supernatant products.

The products situated at the bottom of the tank are periodically discharged either by way of the conveyer screw 46 or with the aid of a valve 46'.

In another embodiment, which has likewise been understaken, decantation is effected in a tank equipped with a device comprising scrapers making it possible to recover the products sinking to the bottom of the tank and also the small amount of floating products.

EXAMPLES

In the examples of performance of the process which will now be described it should be understood that the determination of the dust/tar ratio is effected by sampling the mass decanted in the tank 40. However, this determination, which is periodically necessary, has the sole object of slightly readjusting the setting of the dust/tar ratio. For a given installation the conditions of operation are in fact such that the setting remains stable and that the object of the determination is solely to ensure that there is no deviation from this setting, for example, through accidental clogging of the closure means between the chambers and the charging main. Normally, therefore, the setting does not have to be dependent on a variable measurement, but it is simply required to verify that there is no deviation in the measurement of the dust/tar percentage, which should remain stable if the installation is in conformity with the prescriptions of the invention and with the usual prescriptions. For this reason, it may be considered that the invention sufficiently describes all the means for its performance. The settings must, of course, be verified more carefully in the event of a variation in the supply, but not only are such variations rare in coking plants, but these changes in supply are less important than the changes of granulometry and changes of charging temperature, which in fact are avoided in practice.

Favorable operating conditions according to the invention will first be described, followed by way of comparison by a description of unfavorable operating conditions not in compliance with the invention.

OPERATING CONDITIONS ACCORDING TO THE INVENTION

First the plates 4 were checked to be entirely fluid-tight and to ensure that the valve 32 is in good condition for serving as a balancing limiter valve, and in particular that it can be closed so as to be fluid-tight, thereby ensuring that the charging main remained under pressure.

Series of tests were carried out while maintaining the mass ratio of dusts to tars within the limits of the invention, either by setting the opening time of the plates to a few tenths of minutes instead of to a few minutes, optionally combined with the opening of at least one plate of the same main, although this should correspond to another chamber, or with limited opening of the valve 32; or else by introducing a mix from the main 20 into that of the main 3 by judicious utilization of the valves 22 and 23. In all the cases described in Examples 1 to 5, the temperature of the waters in the decanter was kept between 50° and 80° C. by adding cold water or by controlling losses through evaporation.

EXAMPLE 1

Under the conditions indicated above, 487 chargings were made with coal preheated to 260° C., the granulometry of which ranged from 0–2 mm. The waters at the overflow of the decanter contained 90 mg/l of dusts and 75 mg/l of tars. At the tip of the decanter 34.6 kg of dusts and 23.9 kg of tars were collected on the average per charge, that is to say as the result of intentional adjustment within the range from 1.3 to 1.6 by the means described the mean mass ratio of dusts to tars was 1.50.

EXAMPLE 2

Under the same operating conditions as in Example 1, 568 charging were made with coal preheated to 260° C., the granulometry of which coal ranged from between 0–3 mm. The water at the overflow of the decanter contained 30 mg/l of dusts and 38 mg/l of tars. At the tip of the decanter an average of 27.1 kg of dusts and 18.3 kg of tars was collected per charge, that is to say a mean controlled mass (weight) ratio of dusts to tars of 1.48.

In both examples the product collected at the tip of the decanter was compact and contained no more than 20 to 25% of water. This surprising result is to be compared with 60 to 80% of water obtained with dusts containing 3 to 8% of tars.

In both the above examples, it was possible to work with a complete closed circuit of the ammoniacal waters, for more than one month on each occasion, without any discharge to the drains and without any consumption other than losses through evaporation. The products decant very well. With regard to the product retained by the baffle, it is seen that there is no accumulation; after a certain time it agglomerates, sinks, and passes into the tarry products situated at the bottom of the tank.

The dusts are a mixture of coal and semi-coke. Granulometric analysis gave the following results:

95% (wt %) $< 0.5$ mm
79% (wt %) $< 0.2$ mm
53.4% (wt %) $< 0.1$ mm

These dusts can easily be used as make-up material in coking blend by introduction before the preheating.

OPERATING CONDITIONS NOT IN CONFORMITY WITH THE INVENTION

EXAMPLE 3

One of the plates 5 of the charging main was left permanently open, thus making it possible to observe a dust/tar ratio of 1.23 over 128 chargings. Although the ammoniacal waters were utilizable in a closed circuit, the decanted product was pasty and therefore inconvenient to handle.

EXAMPLE 4

In comparison with Example 3, a second plate of the charging main was left open, thus making it possible to observe a dust/tar ratio of 0.81 over 111 chargings. The ammoniacal waters could once again be used in a closed circuit, but they nevertheless contained 200 mg/l of dusts and 800 mg/l of tars, while the product decanted was in addition fluid and therefore difficult to handle.

EXAMPLE 5

In Example 5 the plates were not quite fluid-tight and permanently allowed tar to escape, so that the main was under negative pressure during the charging. It was necessary to discharge part of the ammoniacal waters to the drains in order to keep the recycling pump 53 under load, while as compensation permanent replenishment was effected with ammoniacal waters coming from the by-product treatment shop (5 to 10 $m^3/h$). These ammoniacal waters carry a heavier charge of tar than those overflowing from the decanter, and as a consequence an abnormally large amount of tar was collected at the tip of the decanter, which partly explains a very low dust/-tar ratio, namely 0.67.

In conclusion, in order to obtain clear ammoniacal waters at the overflow of the decanter and thus to be able to work in a closed circuit with these waters on the charging main without purging or external replenishment, it is necessary for the dust/tar weight ratio to be between 1.3 and 1.6. Outside of this range of the dust:tar weight ratio, the quality of the waters collected at the overflow of the decanter rapidly deteriorates.

Moreover, laboratory tests confirm that for a dust/tar ratio $>1.3$ a solid product is obtained which is easy to handle.

For dust/tar ratios between 1.0 and 1.3 a pasty mixture is obtained which is inconvenient to handle.

For dust/tar ratios $<1$ a viscous product (substantially liquid rather than solid) is obtained which is very difficult to pump.

What is claimed is:

1. In a process of treating a mixture of by-products resulting during charging and distilling bituminous coal, for the production of coke, chambers of a horizontal coke oven battery comprising a hydraulic gas collecting main for offtake of the distillation gas denoted as charging gas main and a principal crude-gas collecting main, wherein opening and closing means providing substantially fluid-tight closure are disposed at least between each chamber and said charging gas main, wherein said mixture comprises gases, dusts, tar and water vapor, the temperature of said mixture being in the range from 600° to 800° C., wherein ammoniacal water is employed in said charging gas and crude-gas collecting mains to cool said mixture, which ammoniacal water-containing mixture is denoted as a mix, wherein said mix which is discharged from the charging gas and crude-gas collecting mains is subjected to a step of decantation to obtain clarified ammoniacal water and a product containing tar and dusts separated from said ammoniacal waters, and wherein said clarified ammoniacal water is recycled to the mains, the improvement consisting of adjusting, at any time during the process up to and during the step of decantation, the weight ratio of said dusts to said tar to a range substantially between 1.3 and 1.6, whereby in the step of decantation said product of tar and dusts is in substantially solid form.

2. A process according to claim 1, wherein, at the moment of charging each chamber, the weight ratio of dusts to tar is controlled by adjusting the opening time of the associated opening and closing means for that chamber connected to the charging gas main to effect during the said opening time the desired weight ratio of dusts to tar.

3. A process according to claim 2, wherein the ratio of dusts to tar is further controlled by also opening an opening and closing means associated with a second chamber connecting said second chamber to said charging main.

4. A process according to claim 2, wherein the weight ratio of dusts to tar is further controlled by controlled introduction of tarry gases coming from the principal crude-gas collection main into the charging main.

5. A process according to claim 2, wherein the temperature of the ammoniacal waters ranges from 50° to 80° C. in the step of decantation.

* * * * *